US006159313A

United States Patent [19]

Jin et al.

[11] Patent Number: 6,159,313

[45] Date of Patent: Dec. 12, 2000

[54] PRODUCTION OF ALUMINUM ALLOY STRIP FOR USE IN MAKING THIN GAUGE FOILS

[75] Inventors: Iljoon Jin; John Fitzsimon, both of Kingston, Canada; Masahiko Katano, Fuji; Ichiro Okamoto, Komaki, both of Japan

[73] Assignee: Alcan International Limited, Montreal, Canada

[21] Appl. No.: 09/302,466

[22] Filed: Apr. 29, 1999

[51] Int. Cl.[7] ..... C22F 1/04

[52] U.S. Cl. ..... 148/551; 148/696; 148/552; 164/463; 29/172; 29/527.7

[58] Field of Search ..... 148/551, 552, 148/696; 164/463; 29/17.2, 527.7

[56] References Cited

U.S. PATENT DOCUMENTS

| | | | |
|---|---|---|---|
| 5,634,991 | 6/1997 | Kamat | 148/551 |
| 5,725,695 | 3/1998 | Ward et al. | 148/552 |
| 5,762,729 | 6/1997 | Nishikawa et al. | 148/551 |

FOREIGN PATENT DOCUMENTS

| | | |
|---|---|---|
| 6-093397 | 4/1994 | Japan . |
| 9-285847 | 11/1997 | Japan . |
| 95-18876 | 7/1995 | WIPO . |

*Primary Examiner*—George Wyszomierski
*Assistant Examiner*—Janelle Combs Morillo
*Attorney, Agent, or Firm*—Cooper & Dunham LLP

[57] ABSTRACT

A continuous cast aluminum alloy strip is used in the production of thin gauge or converter foils. The alloy strip contains 0.4 to 0.8% by weigth Fe and 0.2 to 0.4% by weight Si, has an an cast thickness of less than about 30 mm and contains a substantially single intermetallic species of alpha-phase. The strip is cast using a continuous strip caster, e.g. a block or belt caster.

11 Claims, 1 Drawing Sheet

PRODUCTION OF ALUMINUM ALLOY STRIP FOR USE IN MAKING THIN GAUGE FOILS

BACKGROUND OF THE INVENTION

This invention relates to aluminum alloy sheet products and methods for making them. Specifically, it relates to a process for manufacturing a new aluminum alloy foil re-roll strip and foil stock using a continuous strip casting process.

Thin gauge or converter foils are generally prepared by casting an ingot of an aluminum alloy such as AA1145 in a process known as DC or direct chill casting. The ingots are generally heated to a high temperature, hot rolled to a re- roll gauge thickness of between 1 and 5 mm, then cold rolled to a "foil-stock" gauge typically 0.2 to 0.4 mm thick. The strip is often subjected to an interanneal step during the cold rolling process. The "foil-stock" is then subject to further cold rolling operations, often using double rolling techniques to produce a final foil thickness of about 5 to 150 microns. When rolled to a thickness of between 5 and 10 microns, the final foil product is frequently referred to as converter foil and is used in various packaging applications.

There is a cost advantage to using continuous strip casting as the starting point in manufacture of such foils since homogenization prior to hot rolling is not required, and the amount of hot reduction to form re-roll gauges is greatly reduced. However, continuous strip casting processes apply different cooling conditions during solidification from those in DC casting, and there is an absence of a high temperature homogenization step prior to hot rolling. Consequently when continuous strip casting processes are used with alloys normally prepared by DC casting and homogenization, this results in the formation of different intermetallic species and shell distortion in the cast product which cause surface defects in the final foil stock product. In continuous strip casting, the cooling rate of the strip during casting is generally higher (in some cases much higher) than the cooling rate in large DC ingots. Thus, such alloys processed in a continuous strip casting process also result in foil stock which has a higher supersaturation of solute elements, and therefore has undesirable hardening and softening properties, resulting in difficulties in rolling the foil stock to the final gauge thickness.

A previous method of manufacturing aluminum alloy strip suitable for use in the production of thin gauge foils is described in Furukawa, Laid-Open Japanese Application 6-63397, published Apr. 5, 1994. This document indicates that a wide range of iron and silicon concentrations may be present in the aluminum alloy, e.g. 0.2–0.8% Fe and 0.05–0.3% Si. However, the highest concentrations of silicon tested were not above 0.19%.

It is an object of the present invention to provide a continuous strip casting based process for preparing re-roll and foil stock suitable for trouble-free production of thin foils with no surface defects such as blemishes and streaks.

It is a further object to produce a foil stock in continuous strip form which contains a substantially single intermetallic species of alpha-phase. "Alpha-phase" means an intermetallic phase consisting of Al—Fe—Si where Fe lies in the range of 30 to 33% and Si lies in the range of 6 to 12% (balance Al). The stoichiometry is typically $Fe_3Si_2Al_{12}$ to $Fe_2SiAl_8$.

SUMMARY OF THE INVENTION

The present invention in one aspect relates to a method of manufacturing an aluminum alloy strip for use in the production of thin gauge foils. A molten aluminum alloy is prepared containing iron in an amount of 0.4 to 0.8% by weight and silicon in an amount of 0.2 to 0.4% by weight, then casting the alloy in a continuous strip caster to form a cast strip having a thickness of less than about 30 mm and containing a substantially single intermetallic species of α-phase. The cast strip may be hot rolled to a desired thickness to provide a re-roll stock.

The re-roll stock obtained by the above process has reduced surface defects, commonly referred to as "fir tree effect". The fir tree effect is a surface appearance caused by non-uniform intermetallic distributions in cast material where more than one intermetallic phase is present. The non-uniformity is caused by the solidification of different intermetallic species. The absence of the fir tree effect means that the surface quality of the final foil is improved and the pinhole frequency in the final foil is reduced. It has not previously been possible to achieve this surface quality using a continuous strip casting process.

Thus, a further aspect of the invention relates to an aluminum alloy strip product obtained by the above process and suitable for use in the production of thin gauge or converter foils. It comprises a continuous cast aluminum alloy strip containing 0.4 to 0.8% by weight Fe and 0.2 to 0.4% by weight Si, having an as cast thickness of less than about 30 mm and containing a substantially single intermetallic species of alpha-phase.

The strip stock produced according to this invention is typically rolled to form thin gauge foils having a thickness of about 5 to 150 microns, with reduced surface defects such as pin holes, large holes, streaks and tears in the final product.

The combination of alloy composition and continuous strip casting process has been found to result in the formation, during casting, of substantially 100% alpha-AlFeSi phase. It is this substantially pure alpha-phase that results in fewer surface defects when rolled to the final gauge thin foil products.

The alloy used in the present process contains Fe in the range 0.4 to 0.8%, preferably 0.4 to 0.6% and most preferably 0.42 to 0.48% by weight and Si in the range 0.2 to 0.4%, preferably 0.2 to 0.3% and most preferably 0.22 to 0.28% by weight. The Si/Fe ratio preferably lies in the range 0.25 to 1.0, preferably 0.4 to 0.7 When Si and Fe are within these ranges, the continuous strip casting conditions result in an as cast slab with substantially 100% alpha-AlFeSi phase. If Si is less than 0.2%, significant amounts of $FeAl_6$ phase form and the cast strip is susceptible to shell distortion. If Si exceeds 0.4%, there is a tendency to form beta phase which is also detrimental to rolling. If Fe is less than 0.4%, the strip has too little strength. If Fe exceeds 0.8%, $FeAl_6$ can again form and total amount of intermetallics is also excessive.

Elements such as Mg, Mn, Cu, V, Zn should preferably all be less than about 0.05% by weight. Ti should preferably be less than 0.03%, and all other elements should preferably be less than 0.03%, with the combination of all other elements preferably not exceeding 0.15%.

The strip casting process is preferably carried out in a continuous strip casting process where the strip thickness is less than 30 mm. Preferably the strip thickness is greater than or equal to about 4 mm. The strip casting process should preferably provide an average cooling rate through the thickness of the cast strip of between 20 and 200° C./sec. A cooling rate of less than 20° C./sec results in the formation of surface segregation which results in poor surface quality in the final strip. A cooling rate greater than 200° C./sec results in excessive shell distortion. The actual cooling rate depends on the strip thickness and the mould cooling ability.

The strip casting process preferably is carried out using a block or belt caster. Most preferably a twin belt caster is used, with the casting carried out on textured steel belts.

The as cast slab typically has a secondary dendrite arm spacing of between 8 and 15 microns when cast under the above conditions. The secondary dendrite arm spacing is described along with standard methods of measurement, for example, in an article by R. E. Spear, et al., in the Transactions of the American Foundrymen's Society, Proceedings of the Sixty-Seventh Annual Meeting, 1963, Vol. 71, Published by the American Foundrymen's Society, Des Plaines, Ill., USA, 1964, pages 209 to 215, the disclosure of which is incorporated herein by reference.

The as cast slab is preferably hot rolled to a re-roll gauge without any homogenization step or other additional heating. Preferably a hot rolling process is used with an entry temperature of between about 400° C. and 550° C. and an exit temperature of between about 200° C. to 320° C. to produce a re-roll strip thickness of between 1 and 3 mm, preferably 1 to 2 mm. This re-roll strip is normally coiled and allowed to cool to ambient temperatures before additional processing.

The re-roll strip can then be further processed by cold rolling to form a foil stock. The preferred process involves first cold rolling to one or more intermediate gauges with interannealing steps, then cold rolling to a foil stock. The thickness of the foil stock product is typically from 0.2 to 0.4 mm.

It is particularly preferred that the cold rolling process include a two step interannealing. The interannealing comprises heating an intermediate gauge strip at 350 to 450° C. for at least 0.5 hours, but preferably less than 12 hours and then cooling the strip to 200 to 330° C. and holding for at least 0.5 hours, but preferably less than 12 hours. A cold reduction of at least 40% prior to the interanneal is preferred.

BRIEF DESCRIPTION OF DRAWING

The invention is illustrated by the appended drawings in which.

DESCRIPTION OF THE PREFERRED EMBODIMENTS

Example 1

Figure 1:
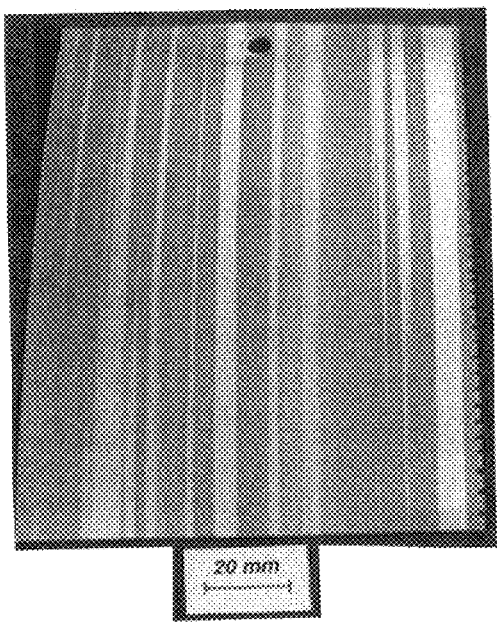
FIG. 1 (Prior Art)
FIG. 1 is a photograph of the etched surface of a rolled strip outside the composition range of the invention.
Figure 2:
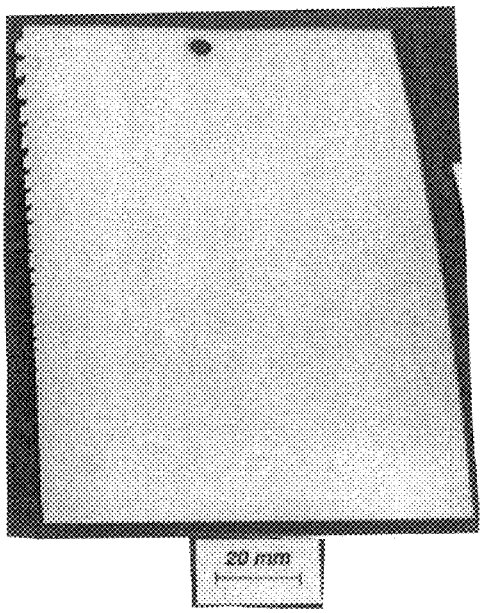
FIG. 2 is a photograph of the etched surface of a rolled strip within the composition range of the invention.

Two aluminum alloys were cast on a laboratory scale twin belt caster. Alloy 1 contained 0.96 wt. % Fe, 0.05 wt. % Si, and the balance essentially aluminum. Alloy 1 composition was therefore outside the range of the present invention. Alloy 2 contained 0.45 wt. % Fe and 0.25 wt. % Si which was within the range of the present invention. The slab thickness was 19 mm and the casting speed was 3 m/min. The resulting slabs were hot rolled to 3 mm and then cold rolled to 0.3 mm. The rolled sheets were then anodized in sulphuric acid solution to reveal the intermetallic phase distribution. This treatment causes dark areas where $FeAl_6$ intermetallics are formed. The results are shown in FIGS. 1 and 2. Alloy 1 (FIG. 1) has a mixture of dark and light areas, indicating that this alloy has a mixture of at least two intermetallic phases. On the other hand, alloy 2 (FIG. 2) shows only a white area, indicating that intermetallics in this alloy are uniform (and of a single type).

Example 2

The procedure of Example 1 was repeated using aluminum alloys containing a range of iron and silicon concentrations The alloy compositions in wt % and the resulting intermetallics are shown in Table 1

TABLE 1

| Alloy No. | Fe (wt. %) | Si (wt. %) | Intermetallics |
|---|---|---|---|
| 3 | 0.31 | 0.09 | Mixed |
| 4 | 0.52 | 0.05 | Mixed |
| 5 | 0.46 | 0.14 | Mixed |
| 6 | 0.54 | 0.27 | Single |

Notes: Mixed intermetallics mean more than one species present. Single intermetallic means substantially all alpha phase.

The results shown in Table 1 demonstrate that the alloy number 6, which has Fe and Si concentrations within the range of the present invention, is free of fir tree image and has a single phase intermetallic.

What is claimed is:

1. A process for manufacturing an aluminum alloy strip suitable for use in the production of thin gauge foils, which comprises providing a molten aluminum alloy containing Fe in an amount of 0.4 to 0.8% by weight and Si in an amount of 0.2 to 0.4% by weight, casting the alloy in a continuous strip caster to form a cast strip having a thickness of less than about 30 mm and containing a substantially single intermetallic species of α-phase.

2. A process according to claim 1 wherein the aluminum alloy contains the Si and Fe in the Si:Fe ratio of 0.25 to 1.0.

3. A process according to claim 2 wherein the aluminum alloy contains 0.42 to 0.48% Fe and 0.22 to 0.28% Si.

4. A process according to claim 2 wherein the aluminum alloy also contains Cu, Mn, Mg, Zn and V in an amount of less than 0.05% by weight, Ti in an amount of less than 0.03% and all other elements in an amount of less than 0.03% by weight.

5. A process according to claim 1 wherein the as cast strip is hot rolled to a thickness of about 1 to 3 mm.

6. A process according to claim 1 wherein the average cooling rate through the thickness of the cast strip during casting is in the range of about 20 to 200° C./sec.

7. A process according to claim 5 wherein the hot rolling of the cast strip is carried out with an entry temperature of between 400 and 550° C. and an exit temperature of between about 200 and 320° C.

8. A process according to claim 5 wherein the hot rolling is carried out without homogenization or additional heating.

9. A process according to claim 1 wherein the aluminum alloy strip obtained is cold rolled to form a foil stock having a thickness of about 0.2 to 0.4 mm.

10. A process according to claim 9 wherein at least two cold rolling procedures are carried out with an interannealing step.

11. A process according to claim 10 in which the interannealing step includes first heating the strip at 350 to 450° C. for at least 0.5 hours, then cooling and holding the strip at 200 to 330° C. for at least 0.5 hours.

* * * * *